United States Patent [19]

Arnal

[11] Patent Number: 4,531,252

[45] Date of Patent: Jul. 30, 1985

[54] HIGH CAPACITY WIRE BRUSHES

[76] Inventor: Claude Arnal, 6, Rue Pelleport, 75020 Paris, France

[21] Appl. No.: 506,369

[22] Filed: Jun. 20, 1983

[51] Int. Cl.[3] ..... A46B 7/08; A46B 13/02

[52] U.S. Cl. ..... 15/179; 15/181; 15/198

[58] Field of Search ..... 15/179, 180, 181, 182, 15/183, 198, 200

[56] References Cited

U.S. PATENT DOCUMENTS

| | | | |
|---|---|---|---|
| 717,851 | 1/1903 | Hirsch | 15/179 X |
| 1,493,670 | 5/1924 | Galvin | 15/198 |
| 1,830,715 | 11/1931 | Poss | 15/162 |
| 2,290,575 | 7/1942 | Potter | 15/181 |
| 2,534,892 | 12/1950 | Wilhide | 15/181 |

FOREIGN PATENT DOCUMENTS

| | | | |
|---|---|---|---|
| 370531 | 12/1906 | France | 15/181 |

*Primary Examiner*—Peter Feldman
*Attorney, Agent, or Firm*—Theodore Hafner

[57] ABSTRACT

The invention consists of arranging a number of wire bundles on a supporting disc in openings of the disc, provided in circular rows coaxial with the disc and at different distances from the periphery of the disc.

8 Claims, 6 Drawing Figures

Figure 5:
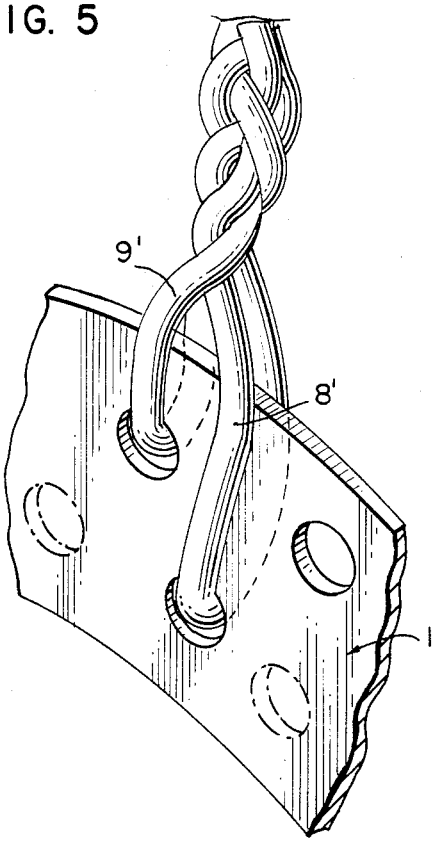

FIG.1
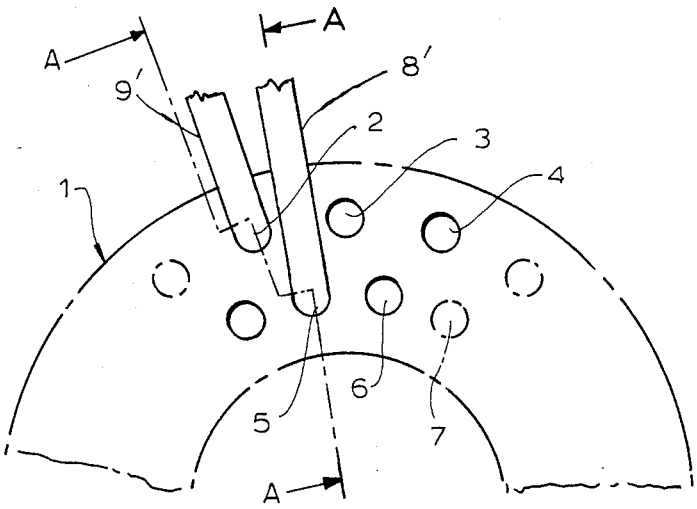
FIG.2
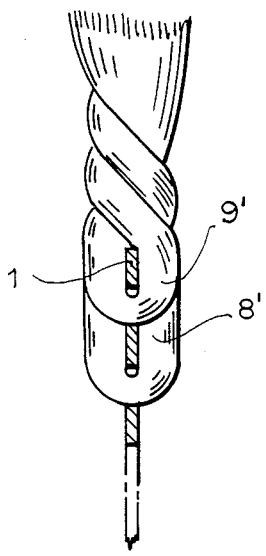
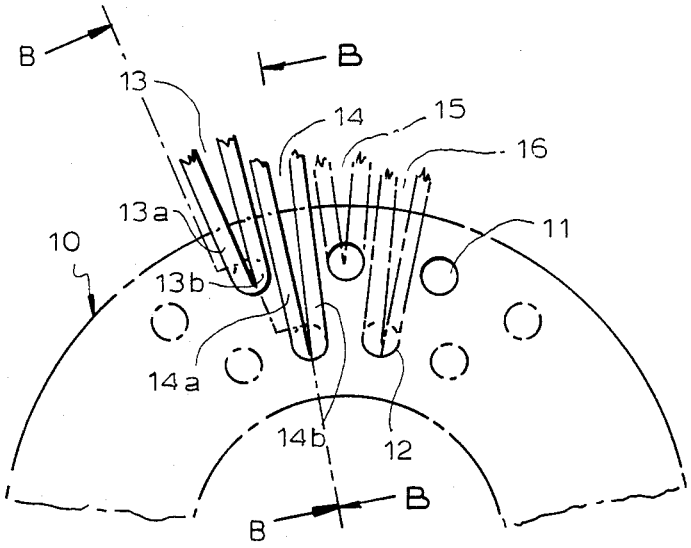
FIG.3
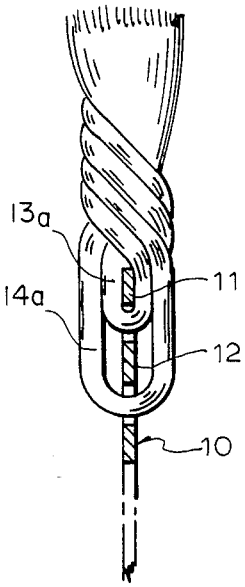
FIG.4

HIGH CAPACITY WIRE BRUSHES

One of the objects of the invention provides a rotatable wire brush supported on a heat conducting disc, with wire bundles of different lengths supported thereon to increase heat conduction from wire to disc, and conversely, to an optimum.

Another object of the invention is to provide a number of wire bundles in a radial array extending from a common center to a circular working surface in the form of radii of different lengths, preferably of alternatingly varying lengths, so as to produce substantially an equal distribution of heat along the brush.

A more specific embodiment of the invention is to provide along at least one surface of a supporting metal disc, or of any other type of heat conducting element, acting as brush support, a number of wire bundles arranged in holes forming at least two circular arrays of different diameters coaxial with the supporting disc.

A further object of the invention is to attach wire bundles of different lengths to circular rows of holes of different diameters provided on a heat conducting supporting disc, the diameters of the circular rows corresponding to the lengths of the wire bundles so as to permit the different wire bundles to extend from their supporting holes to the periphery of the disc forming a working surface.

Still another object to the invention is to attach wire bundles of different lengths by supporting the bundles through passage through holes provided in a supporting disc at distances corresponding to the lengths of the different wire bundles, so as to form a working surface corresponding to the periphery of the supporting disc.

It is also an object of the invention to provide holes permitting passage of the wire bundles from one side of the disc to the other side radially extending to, and joining at the periphery of the disc, each of the wire bundles having a length corresponding to the position of its supporting hole, the length of each wire bundle being different from the adjoining wire bundle.

A particular embodiment of the invention is to support a number of wire bundles in holes of a supporting metal disc permitting passage of the wires from one side of the disc to the other, each of said wire bundles being longitudinally split in demi-portions joined at the periphery of the disc with corresponding demi-portions of adjoining wire bundles.

In a specific embodiment of this application of the invention, adjoining wire bundles have different lengths corresponding to different distances of the supporting holes from the periphery of the disc thus forming at the periphery of the disc, wire bundles consisting of demi-portions of different lengths, derived from different holes positioned at different distances from the periphery of the supporting disc.

In a modification of this embodiment, the different split portions emerging from the periphery of the disc, and from both sides of the disc, form at the periphery, or at a predetermined distance, therefrom, a substantially continuous brushing surface.

In a further specific embodiment of the invention, the wire bundles supported on a heat conducting carrier in holes permitting passage of the wire bundles from one side of the carrier to the other side, are during that passage longitudinally split, and after that passage when arriving at the periphery of the carrier are spliced together forming a continuous working surface.

In a modification of this embodiment of the invention, adjoining wire bundles are derived from holes displaced with respect to each other being of different length.

In another modification of the invention, adjoining split portions of wire bundles being derived from displaced holes, and emerging from the periphery of their carrier, are spliced together forming a substantially continuous working surface.

In a further modification of the invention, the split portions of the wire bundles, being of different length and derived from displaced carrier elements, are spliced by being twisted together in opposite directions at predetermined angles with respect to each other, to form a substantially uniform working surface when emerging from the periphery of the supporting carrier.

These and other objects of the invention will be more apparent from the drawings annexed herewith, in which:

FIGS. 1 and 2 in front and side views, respectively, the latter in section along A—A in FIG. 1, with a perspective view shown as FIG. 5, represent schematically, wire bundles supported on displaced holes.

Figure 6:
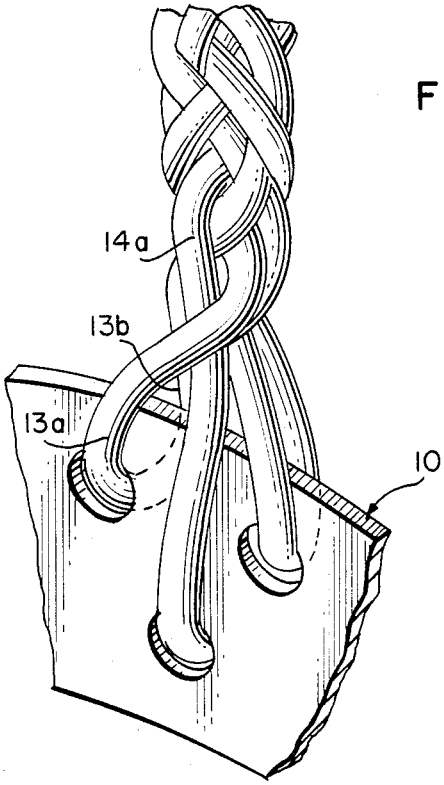

FIGS. 3 and 4, also in front and side views, respectively, the latter in section along B—B in FIG. 3, with a perspective view shown as FIG. 6, represent schematically wire bundles split, alternating portions being spliced at different sizes.

In FIGS. 1 and 2 a supporting plate consisting of aluminum and schematically indicated at 1, is shown to be provided with two coaxial rows of circular holes relatively displaced with respect to each other, schematically indicated at 2, 3, 4 . . . etc. for the row with the larger diameter, and 5, 6, 7, . . . etc. for another row of smaller diameter, the holes of the latter row being peripherally displaced with respect to the former so as to permit wire bundles of different lengths to pass from one side of the disc 1 to the other side, as schematically indicated in the cross section of FIG. 2 at 8, 9 and in FIG. 1 indicated by dotted lines 8', 9'.

Any desired distance or position of the different holes may be applied without departing from the scope of this invention. Similarly any desired type or lengths or composition of the wire bundles may be applied in accordance with the invention.

In a modification of the invention, also schematically illustrated in FIGS. 3 and 4, the aluminum disc, or any other carrier, mechanically and heat-conductively suitable, is schematically indicated at 10, with displaced rows of holes schematically indicated at 11, 12, respectively, in a manner similar to that shown in FIGS. 1, 2.

In addition, however, to the displacement of supporting holes for wire bundles of different lengths, the wire bundles themselves, when passing through the supporting holes, are split in one or more subsections, thereby permitting them to be joined with adjacent subsections of other wire bundles similarly split off. As a result due to these additional interconnections between adjoining wire bundles, not only the resulting heat conductivity will be improved but also the mechanical cohesion and resistivity of the entire brush will be increased, making the resulting brush capable of high speed applications with a reduced danger to the operator.

In FIGS. 3 and 4, the half portions, or subsections of the wire bundles 13, 14—which in accordance with the invention can be of different lengths, are schematically illustrated at 13*a,b,* and 14*a,b,* respectively, and in accordance with the present modification adjacent or adjoining subsections of different wire bundles are spliced together, to form a new wire bundle schematically indicated in FIG. 3 at 15, on one side of a wire bundle, and 16, on the other side.

The splicing or interconnection of the differently sized but adjoining subsections, or (as in FIG. 3 of the demi-sections) occurs in otherwise well known manner, by forming knots, or any other interconnection or splicing, without affecting the essence of the invention.

Generally the invention may be applied in any form or manner whatsoever without departing from its frame work.

I claim:

1. In combination, a disc-shape carrier of heat conducting material having at least one series of openings arranged in a circle coaxial with the disc; a number of wire bundles supported on said openings, and extending from one side of the disc to the other side; said disc having another series of openings arranged in another circle coaxial with the disc but of a diameter different from that of the first circle with its openings peripherally displaced with respect to the openings of the first circle; and a number of further wire bundles supported on said further openings, and extending from one side of the disc to the other side and intertwined with the number of wire bundles from said one series of openings so as to form knots, the ends of said knots forming a working surface; so as to present on each side of the disc wire bundles of alternatingly different lengths extending from their corresponding openings in radial direction to a predetermined distance beyond the periphery of the disc.

2. Combination according to claim 1, wherein at least a portion of the ends of the wire bundles, emerging from the periphery of the disc, are intertwined so as to form knots; the ends of said knots forming a working surface.

3. Combination according to claim 2, wherein the wire bundles emerging from the disc are intertwined as a whole.

4. Combination according to claim 2, wherein the wire ends extending from the disc are individually intertwined so as to produce a relatively homogeneous working surface.

5. Combination according to claim 2, wherein the wires extending from the disc are crimped and intertwined so as to improve heat conduction.

6. Combination according to claim 1, wherein the cross sections of wire bundles of different lengths are different as a function of the heat conductivity; the longer wire bundles being in larger contact with the supporting disc.

7. Combination according to claim 1, wherein for wire bundles of different lengths supported on the disc, the product of effective wire bundle cross section and wire bundle length, is substantially constant.

8. Combination according to claim 1, wherein the product of effective wire area and effective wire length is substantially constant.

* * * * *